US009278784B2

(12) United States Patent
Wood et al.

(10) Patent No.: US 9,278,784 B2
(45) Date of Patent: Mar. 8, 2016

(54) DEVICE FOR CAPPING A CONTAINER NECK

(75) Inventors: Christopher Wood, Wauwatosa, WI (US); Michel Luzzato, Ecully (FR); Veronique Bernard, Anse (FR); Grégory Antier, Trévoux (FR)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 13/824,615

(22) PCT Filed: Mar. 8, 2012

(86) PCT No.: PCT/EP2012/053993

§ 371 (c)(1), (2), (4) Date: May 17, 2013

(87) PCT Pub. No.: WO2012/120075

PCT Pub. Date: Sep. 13, 2012

(65) Prior Publication Data

US 2014/0001182 A1 Jan. 2, 2014

(30) Foreign Application Priority Data

Mar. 9, 2011 (FR) ..... 11 51920

(51) Int. Cl.
*B65D 41/58* (2006.01)
*B65D 41/00* (2006.01)
(Continued)

(52) U.S. Cl.
CPC ..... *B65D 41/005* (2013.01); *B65D 41/04* (2013.01); *B65D 41/58* (2013.01); *B67B 6/00* (2013.01)

(58) Field of Classification Search
CPC ..... B65D 41/05; B65D 41/04; B65D 41/58; B67B 6/00
USPC ..... 215/320, 349, 350, 354, 364, 346, 351, 215/252, 345
See application file for complete search history.

(56) References Cited

U.S. PATENT DOCUMENTS 3,462,034 A * 8/1969 Friedberg ..... 215/329
6,044,995 A 4/2000 Dai
(Continued)

FOREIGN PATENT DOCUMENTS

CN 2863675 Y 1/2007
CN 201334170 Y 10/2009
(Continued)

OTHER PUBLICATIONS

International Search Report of PCT/EP2012/053993, mailed on Mar. 30, 2012, 2 pages.

*Primary Examiner* — Mickey Yu
*Assistant Examiner* — Niki Eloshway
(74) *Attorney, Agent, or Firm* — Finnegan, Henderson, Farabow, Garrett & Dunner, L.L.P.

(57) ABSTRACT

A capping device includes an external outer cap adapted to be removably fixed to the exterior face of a container neck, and an internal insert adapted to plug the opening of the neck. The insert is adapted to be fitted to the neck independently of the outer cap and before fitting the outer cap to the neck. When it is fitted to the neck, the outer cap is adapted to be permanently fastened to the insert. When filling the container, the insert may include means for retaining it on the neck adapted to connect the insert mechanically to the neck before the outer cap is fitted to the neck, thereby sealing at least the exterior peripheral surface of the free end of the neck against a cleaning liquid applied externally to the neck.

11 Claims, 5 Drawing Sheets

(51) Int. Cl.

| | |
|---|---|
| ***B65D 41/04*** | (2006.01) |
| ***B67B 6/00*** | (2009.01) |
| *B65D 41/34* | (2006.01) |

(56) References Cited

U.S. PATENT DOCUMENTS

| | | | | |
|---|---|---|---|---|
| 6,761,275 | B1 * | 7/2004 | McBride et al. | 215/349 |
| 7,163,115 | B2 * | 1/2007 | Whitley | 215/276 |
| 7,611,026 | B1 * | 11/2009 | Bloom et al. | 215/276 |
| 7,703,626 | B2 * | 4/2010 | Witt | 220/276 |
| 7,784,629 | B2 * | 8/2010 | German et al. | 215/276 |
| 7,874,441 | B2 * | 1/2011 | Bloom et al. | 215/276 |
| 2005/0284837 | A1 * | 12/2005 | Taber et al. | 215/276 |
| 2007/0095782 | A1 * | 5/2007 | Granger et al. | 215/351 |
| 2007/0138125 | A1 * | 6/2007 | Granger | 215/312 |
| 2007/0187352 | A1 * | 8/2007 | Kras et al. | 215/276 |

FOREIGN PATENT DOCUMENTS

| | | | |
|---|---|---|---|
| EP | 1 254 848 | A2 | 11/2002 |
| FR | 2 219 081 | A1 | 9/1974 |
| GB | 1 316 162 | A | 5/1973 |
| JP | 2006-160301 | A | 6/2006 |

* cited by examiner

DEVICE FOR CAPPING A CONTAINER NECK

CROSS-REFERENCE TO RELATED APPLICATIONS

This is a U.S. National Phase of PCT/EP2012/053993, filed Mar. 8, 2012, which claims the benefit of priority to French Patent Application No. 11 51920, filed Sep. 3, 2011, which is incorporated herein by reference.

TECHNICAL FIELD

The present invention concerns a device for capping a container neck.

The invention relates generally to caps comprising two main components, namely an external outer cap, which is designed to be fixed removably around the neck of a container, notably by screwing-unscrewing, and an internal insert, which is designed to block the neck in sealed manner and which, during assembly of the cap, is permanently fastened inside the outer cap.

BACKGROUND

In a field that the invention does not concern capping devices of this type are known in which the insert is first added to and permanently fixed inside the outer cap, before thereafter placing on a container neck to be capped the combination consisting of the assembly of this insert and this outer cap. U.S. Pat. No. 6,044,995, GB-A-1 316 162 and FR-A-2 219 081 provide examples of this: in all cases, the proposed inserts are a priori incapable of being added to the free end of a container neck and retained in sealed manner if the outer cap of the device is not conjointly present with the insert.

In contrast to what has just been described, the invention specifically concerns caps for which the insert is designed to be fitted to the neck independently of the outer cap so that this insert is advantageously placed on the neck before the outer cap is fitted afterwards. EP-A-1 254 848 provides one example of such a cap. The preamble of the appended claim 1 is based on EP-A-1 254 848.

The benefit of such a cap structure is linked to sanitary considerations: accordingly, in EP-A-1 254 848, after a container is filled in an aseptic filling enclosure, the insert alone can be easily fitted, also in this aseptic enclosure, so as to hermetically seal the neck without biological contamination of the content of the container, before the container is transferred into a non-aseptic bottling area, in which the outer cap is fitted to the neck already plugged by the insert.

This being so, current capping devices, including that proposed by EP-A-1 254 848, do not provide a satisfactory solution for situations where, when filling the container, the exterior face of the neck thereof is soiled by the product with which the container is filled. Indeed, in the event of overfilling, product overflows the neck and runs down its exterior face. Runs can also be produced in the event of leaks or splashes originating from the filling system. The situation is the same for all products tending to foam up, such as beer. Moreover, for beer in particular, the formation of foam is even intended so that this foam occupies all of the free volume of the neck, above the surface of the beer, and thus expels the air initially present. In this case, considerable runs of foam systematically occur and therefore significantly soil the exterior face of the neck. The residues of the liquid, left by these runs, often lead to biological contamination of the neck of the container by yeasts or the like.

BRIEF SUMMARY

The object of the present invention is to propose a capping device of the type referred to above that makes it possible to limit the risk of biological contamination of a container neck to be closed by this capping device.

To this end, the invention consists in a device for capping a container neck as defined in the appended claim 1.

One of the ideas on which the invention is based is to seek to clean the neck with an ad hoc cleaning liquid after the neck has been plugged by the insert but before fitting the outer cap around the neck. In practice, to do this, the insert is, in accordance with the invention, designed, during its fitting, to be mechanically connected to the neck, in particular sufficiently so to remain in place during application of the cleaning liquid, typically effected by spraying, and thus at a certain pressure, as well as during subsequent drying, typically effected by blowing air, and thus also at a certain pressure. If an overpressure exists inside the neck of the container, linked notably to the presence of a gassy product, such as beer, in the container, the aforementioned mechanical connection is made sufficient to resist this overpressure, at least for the time taken to clean the neck of the container. Moreover, the insert of the device of the invention effectively seals the free end of the neck from the outside: in this way, the cleaning liquid does not insinuate itself between the insert and the free end of the neck, notably on the edge of the neck, to prevent traces of this cleaning liquid thereafter remaining on the edge and then being ingested by the user, notably through mixing with the product poured via the neck of the container. Thus after filling a container and capping the neck with the insert of the device of the invention, most of the exterior face of the neck, in particular the main part of the neck where the outer cap will be removably fixed, typically by screwing-unscrewing, may be cleaned effectively and rapidly, without running the risk that, during the cleaning operations as such, the insert is moved or raised relative to the neck, then allowing the cleaning liquid to pass toward the interior of the container.

Advantageous additional features of the capping device of the invention, taken separately or in all technically possible combinations, are specified in the dependent claims 2 to 14.

BRIEF DESCRIPTION OF THE DRAWINGS

The invention will be better understood on reading the following description given by way of example only and with reference to the drawings, in which.

DETAILED DESCRIPTION

Figure 1:
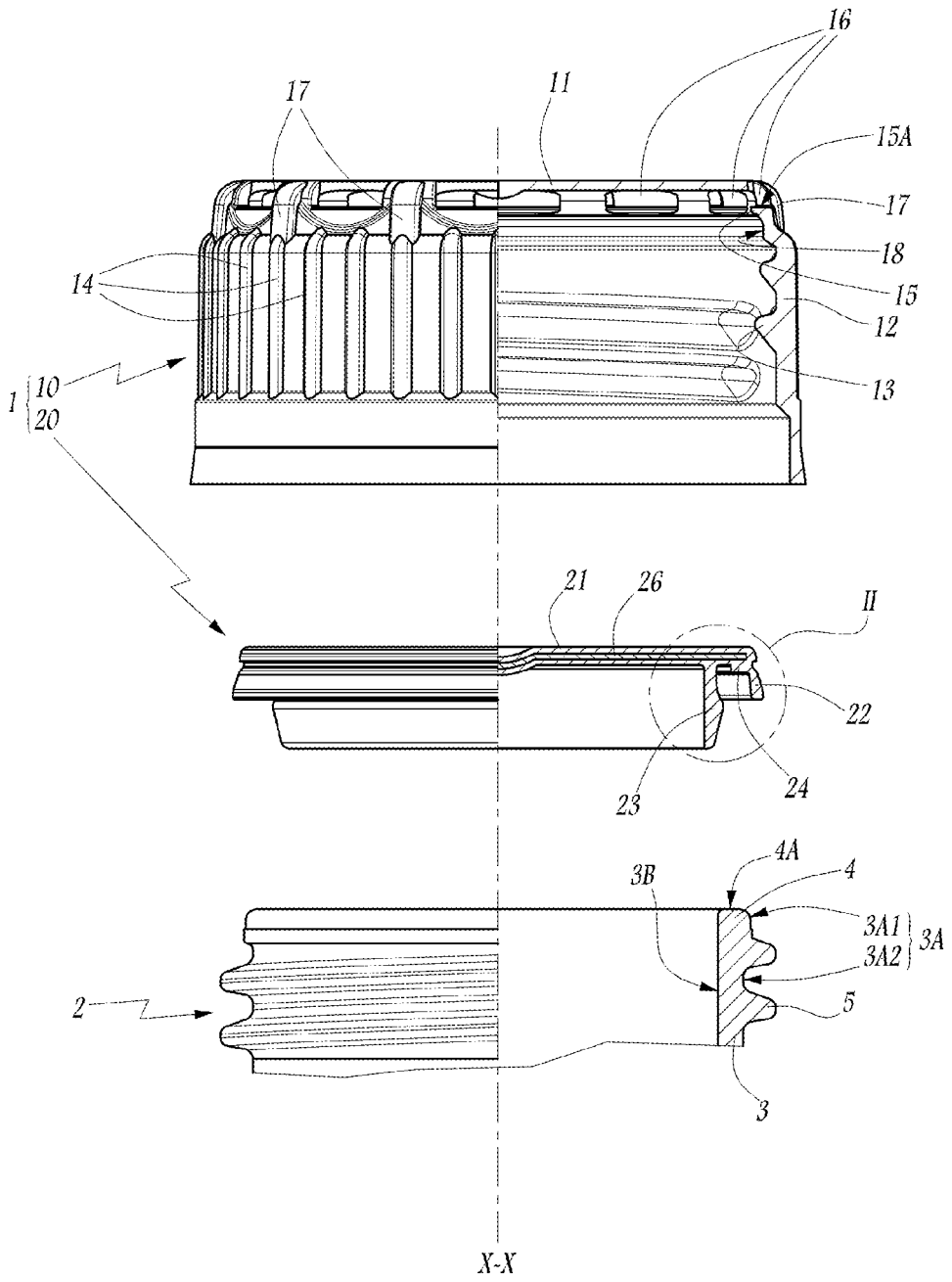
FIG. 1 is an exploded view of a capping device of a first embodiment of the invention associated with a container neck to be closed by this device, the left-hand half of this figure being an elevation view of the device and the neck while the right-hand half is a longitudinal section through these elements.
Figure 2:
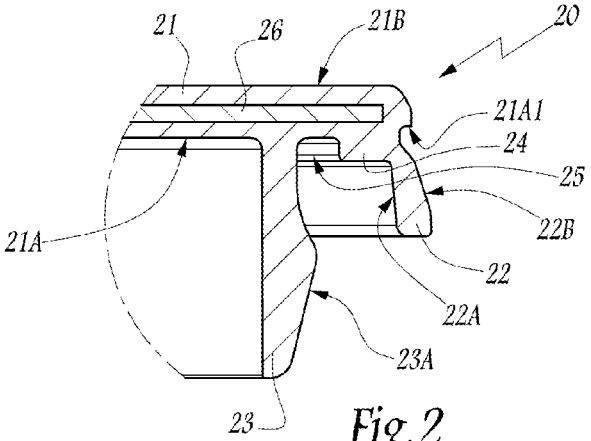
FIG. 2 is a view to a larger scale of the ringed area II in FIG. 1.

In FIGS. 1 to 6 there is represented a device 1 for capping a neck 2 of a container.

In practice, the neck 2 is either made in one piece with the rest of the container, notably when the latter is a glass or plastic material bottle, or adapted to be permanently fastened to a wall of the container, in an opening passing through that wall.

The neck 2 has a globally tubular shape, with a central longitudinal axis X-X. For convenience, the remainder of the description is oriented taking the terms "upper" and "top" as corresponding to a direction globally parallel to the axis X-X and extending from the body of the container toward the free end of its neck 2, i.e. an upward direction in the figures, while the terms "lower" and "bottom" correspond to an opposite direction.

The neck 2 includes a globally cylindrical body 3 with a circular base and axis X-X. At its top end 4, this body 3 delimits an edge 4A at the level of which the product contained in the container is intended to be poured out. The exterior face 3A of the body 3 includes, successively from top to bottom, the exterior surface 3A1 of the end 4 and the exterior surface 3A2 of the main part of the body 3, which is provided with a helical thread 5 projecting radially outward.

The device 1 primarily comprises two components, namely an external outer cap 10 and an internal insert 20.

Figure 5:
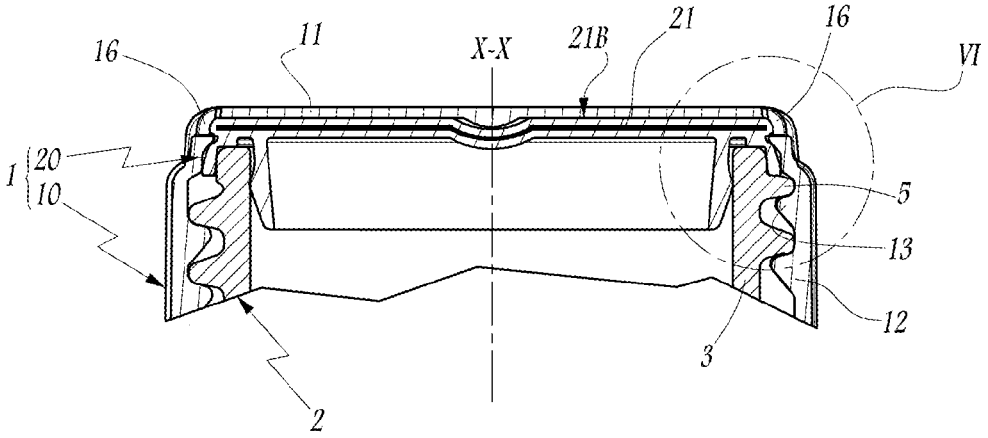
FIG. 5 is a view analogous to FIG. 3, showing a subsequent step of capping the neck of the container with the device from FIG. 1.

As can be seen clearly in FIG. 1, the outer cap 10 has a globally tubular shape, the central longitudinal axis of which coincides with the axis X-X of the neck 2 when the device 1 is fitted to the neck (FIG. 5). The outer cap 10 is open at its lower end and closed at its upper end by a plane end wall 11 at the exterior periphery of which a tubular skirt 12 centred on the axis X-X extends downward. The main part of the interior face of the skirt 12 is provided with a screwthread 13 projecting radially inward and complementary to the exterior screwthread 5 of the neck 2, thus enabling the outer cap 10 to be screwed onto and unscrewed from the neck. To facilitate grasping and turning this outer cap, the exterior face of the skirt 12 is provided with projecting ribs 14, which extend lengthwise parallel to the axis X-X and are distributed in a substantially uniform manner around the exterior periphery of the skirt, as can be seen clearly in FIG. 1. The embodiment of these ribs 14 shown in the figures is merely illustrative and is not limiting on the invention in that diverse other shapes for facilitating turning of the outer cap by a user may be envisaged.

In its upper end part, the skirt 12 is internally provided with a plurality of tabs 15 all of which are globally situated in the same plane perpendicular to the axis X-X, being distributed in a substantially regular manner along the interior periphery of the skirt. In practice, and as in the embodiment shown in the figures, the aforementioned plane is situated, along the axis X-X, more or less half way between the end wall 11 and the axial level of the upper end of the thread 13. Each tab 15 projects radially inward from the interior face of the skirt 12. Thus each tab 15 delimits, facing the end wall 11, a substantially plane upper surface 15A, the surfaces 15A of the various tabs 15 all lying in a plane perpendicular to the axis X-X.

Also in its upper end part, the skirt 12 delimits a plurality of openings 16 all of which are globally situated in the same plane perpendicular to the axis X-X, being distributed in a substantially regular manner Around the periphery of the skirt. The openings 16 occupy the same peripheral portions of the skirt 12 as the tabs 15, being situated, along the axis X-X, between the plane containing the tabs 15 and the end wall 11. In other words, each of the openings 16 thus passes completely through the wall of the skirt 12, opening onto one of the tabs 15 inside the outer cap 10. Around the periphery of the skirt 12, the wall of the latter between two successive openings 16 is solid, having internally no tabs similar to the tabs 15, more generally being free of any raised pattern projecting radially inward. The benefit of the tabs 15 and the openings 16 will become apparent later.

The upper end part of the skirt 12 is advantageously provided externally with projecting ribs 17 that extend lengthwise between the upper end of the exterior face of the skirt 12, in other words the axial level of the end wall 11, and the axial level at which are situated the upper ends of the ribs 14 present in the main part of the exterior face of the skirt. Around the periphery of the skirt, these ribs 17 can obviously not be present in the portions occupied by the openings 16: in fact, each of the ribs 17 is systematically provided between two successive openings 16, as can be seen clearly in FIG. 1. Moreover, the width of the ribs 17, i.e. their dimension in the peripheral direction of the skirt 12, is greater than that of the ribs 14. As a result of this these ribs 17 confer on the outer cap 10 a singular exterior aesthetic, redolent of the usual exterior shape of beer bottle crown outer caps. The ribs 17 also have the benefit of stiffening and mechanically strengthening the portions of the wall of the skirt 12 successively separating the openings 16. This mechanical strengthening will be exploited during assembly of the device 1, as explained later, as well as on removal of the outer cap 10 from the mould when the latter is made from a moulded plastic material.

Considering the insert 20 in more detail now, it is seen that the latter comprises a main body 21 having a globally disc-like shape, centred on an axis which, when the device 1 is assembled and fitted to the neck 2, substantially coincides with the axis X-X. As can be seen clearly in FIG. 2, the body 21 is provided on its lower face 21A with two sealing lips 22 and 23 which have respective annular shapes, coaxial with each other and centred on the axis X-X, and projecting axially from the face 21A of the body 21. For reasons explained later, the external face 23A of the lip 23 has a radially projecting raised pattern which, in the embodiment shown in the figures, consists of a boss 23A1 with a rounded top. Moreover, between these lips 22 and 23 in a direction radial with respect to the axis X-X, the lower face 21A of the body 21 is provided with a projecting heel 24 that is arranged in the connecting area between the face 21A and the internal face 22A of the lip 22 radially farther from the axis X-X than the lip 23. Accordingly, as can be seen clearly in FIG. 2, a free space 25 is provided axially below the face 21A of the body 21, radially between the heel 24 and the connecting area between this face 21A and the external face 23A of the lip 23.

The benefit of the technical aspects of the insert 20 that have just been described will become clear shortly, on describing an example of the installation of the device 1 on the container neck 2.

Accordingly, initially, it is considered that the container, the neck 2 of which is represented in the figures, has just been filled with a product, where appropriate a foaming product, such as beer. For diverse reasons it is found that this filling operation, where applicable with the formation of foam, very often leads to soiling of the exterior face 3A of the neck 2, in particular to soiling of the threaded surface 3A2 of this face 3A.

Figure 3:
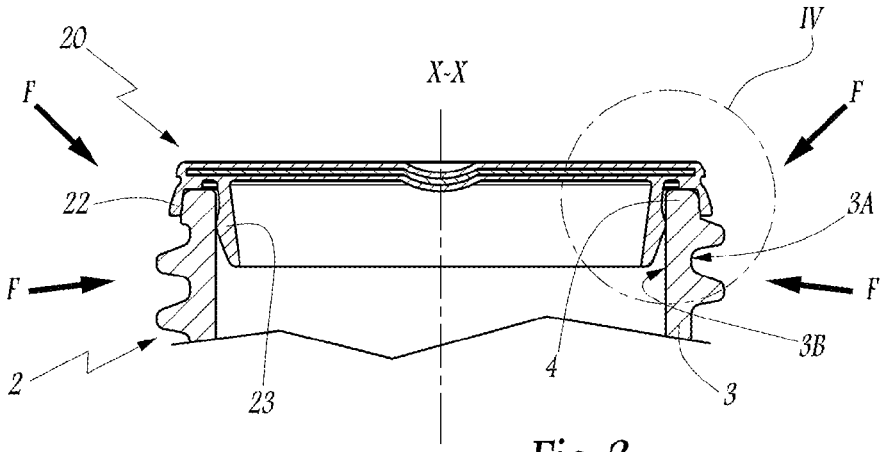
FIG. 3 is a view in longitudinal section of a component of the device from FIG. 1, fitted to the neck, thus showing a step of capping of this neck by the device.

Independently of the outer cap 10, the insert 20 is then placed on the neck 2, being both aligned on the axis X-X and placed across the top end 4 of the neck 2 in order to block the central opening of the body 3 of the neck: the insert 20 is then in the configuration represented in FIG. 3. To be more precise, the body 21 of the insert 20 transversely covers the end 4 of the neck 2, with its lower face 21A blocking the opening of the neck. In the direction of the axis X-X, the body 21 occupies a position in which the heel 24 bears axially in sealed manner against the edge 4A of the neck 2, to be more precise against an exterior peripheral part 4A1 of this edge, as can be seen clearly in FIG. 4. At the same time, the lips 22 and 23 are pressed in sealed manner against the exterior face 3A and the interior face 3B, respectively, of the body 3 of the neck 2: given the shapes and the dimensions of the lips 22 and 23, the internal face 22A of the lip 22 bears in sealed manner against the exterior surface 3A1 of the end 4 of the neck 2, while the boss 23A1 on the external face 23A of the lip 23 bears in sealed manner against the interior surface of the main part of the body 3 of the neck 2. Also at this same time, the free space 25 is provided in vertical axial alignment with the interior peripheral part 4A2 of the edge 4, as can be seen clearly in FIG. 4.

By virtue of their flexible deformation, resulting from their interference with the body 3 of the neck 2, the lips 22 and 23, in addition to their sealing action described above, provide a mechanical action of retention of the insert 20 relative to the neck 2 once this insert is fitted to the neck in this way. Indeed, in that, given their dimensions relative to the body 3 of the neck 2, each of these lips 22 and 23 is partially deformed relative to the body 21, tending to revert elastically to their initial configuration, typically their configuration on removal from the mould, thus procuring an effect of mechanical connection with the body 3 of the neck 2, notably by friction, wedging, adhesion, etc. In practice, given their respective dimensions, it is the interior lip 23 that produces the greater part of the aforementioned mechanical connection effect, by virtue of friction of its boss 23A1 against the interior face 3B of the body 3 of the neck 2, this friction producing a radial loading of the lip 23 against the interior of the neck 2, the intensity of which is directly dependent on the designed interference between the maximum outside diameter of the lip 23, i.e. its diameter at the axial level of the boss 23A1, and the inside diameter of the body 3 of the neck 2. Moreover, it is clear that one of the benefits of the free space 25 is to allow the lip 23 to retain its elasticity over time, i.e. following repeated opening and closing of the device 1, and thus to retain its sealing performance in the long term.

The benefit of the mechanical connection referred to above is that, in the next step of the capping process, a cleaning liquid is applied to the neck 2, in particular by being sprayed onto this neck as indicated by the arrows F in FIG. 3, so as to clean off soiling present on the exterior face 3A of the body 3, notably the threaded surface 3A2 left uncovered by the lip 22. Accordingly, the aforementioned cleaning liquid can be applied with a certain pressure, strengthening its cleaning efficacy, with no risk of moving or lifting the insert 20 retained on the neck. Similarly, application of the cleaning liquid is advantageously followed by a step of drying this liquid, typically by blowing air, where appropriate compressed air. Again, this drying step is carried out with no risk of moving or lifting the insert 20 relative to the neck. More generally, these cleaning steps are thus carried out without the cleaning fluid being able to insinuate itself into the neck 2, this liquid being stopped by the seal produced by the lip 22.

It will be noted that, in the situation where an overpressure exists inside the neck 2, as is the case when the container is filled with beer or, more generally, a gassy product, the mechanical retention effect and the sealing effect that are produced by the sealing lip 23 can easily be such that the insert 20 resists the overpressure, without moving, at least for a sufficient time for carrying out the cleaning steps. As for the mechanical retention effect and the sealing effect, which are produced by the lip 22, they are advantageously strengthened by this overpressure because it tends to cause the body 21 to bow slightly toward the outside, which, through a lever effect, presses the internal face 22A of the lip 22 more strongly against the surface 3A1 of the end 4 of the neck 2.

Figure 6:
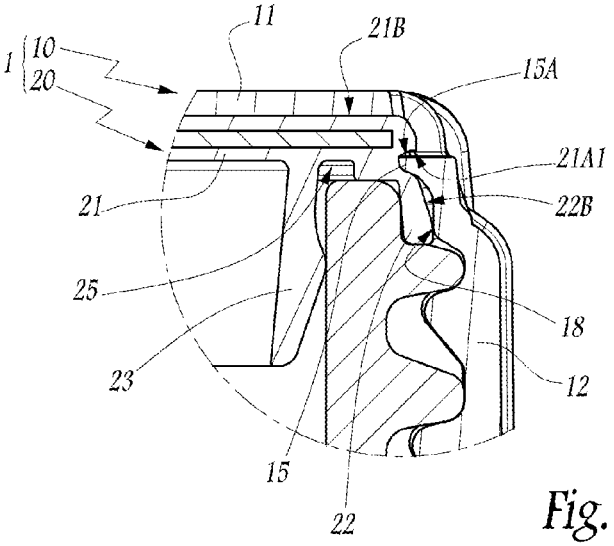
FIG. 6 is a view to a larger scale of the ringed area VI in FIG. 5.

The capping of the neck 2 thereafter continues with fitting the outer cap 10. As represented in FIGS. 5 and 6, the outer cap 10 is fitted around the neck 2 on which the insert 20 is already installed, being centred on the axis X-X and being driven downward until its end wall 11 comes to bear against the upper face 21B of the body 21 of the insert 20. In so doing, the internal thread 13 of the outer cap is engaged with the external thread 5 of the neck 2.

As explained in detail hereinafter, this fitting of the outer cap 10 causes the outer cap and the insert 20 to be fastened together. The body 21 of the insert is designed with dimensions such that its exterior periphery cooperates through complementary shapes and interference with the tabs 15 and the openings 16 of the outer cap 10. To be more precise, on the one hand, the body 21 has, at least at its exterior periphery, a thickness, i.e. a dimension along the axis X-X, substantially equal to or slightly less than the axial separation between the plane containing the upper surfaces 15A of the tabs 15 and the lower face of the end wall 11. On the other hand, the lower face 21A of the body 21 includes a substantially plane exterior peripheral surface 21A1 that connects the external face of the lip 22 and the peripheral edge surface at the end of the body 21, and that is situated relative to the axis X-X at a distance substantially identical to that between that axis and the surfaces 15A of the tabs 15. In other words, the exterior peripheral surface 21A1 of the lower face 21A of the body 21 forms a shoulder that is complementary to the tabs 15, thereby enabling the latter to retain the insert 20 in the axially downward direction once the end wall 11 of the outer cap 10 has been brought to bear against the upper face 21B of the body 21, as can be seen clearly in FIG. 6. In practice it is clear that, for the tabs 15 to be located axially below the body 21 and for the exterior peripheral surface 21A1 of its lower face 21A to bear down on them, the exterior periphery of the body 21 and the upper end part of the skirt 12 are subjected to elastic deformation stresses, it being noted that the openings 16 facilitate and accommodate such deformation, preventing damage to the insert or the outer cap.

Once the outer cap 10 has been fitted in this way, the insert 20 is permanently fastened to the outer cap, in the sense that, on subsequent opening of the device 1, i.e. when the user unscrews the outer cap 10, the latter entrains the insert 20 with it, at least in translation in the direction of the axis X-X. In other words, the insert 20 is trapped inside the outer cap 10, through the exterior periphery of its body 21 bearing axially downwards on the tabs 15.

The skirt 12 is advantageously sized so that, when the insert 20 is fitted inside the outer cap 10 in this way, in its axial part situated below the tabs 15 and above the thread 13, its internal face bears radially against the external face 22B of the lip 22. In other words, axially between the plane in which the tabs 15 are situated and the upper end of the thread 13, the skirt has internally a surface 18 the diameter of which interferes with the outside diameter of the lip 22. In this way, when the outer cap 10 is screwed all the way onto the neck 2, the surface 18 reinforces the bearing of the lip 22 against the external face 3A of the neck and thus enhances the sealing performance of this lip.

Figure 4:
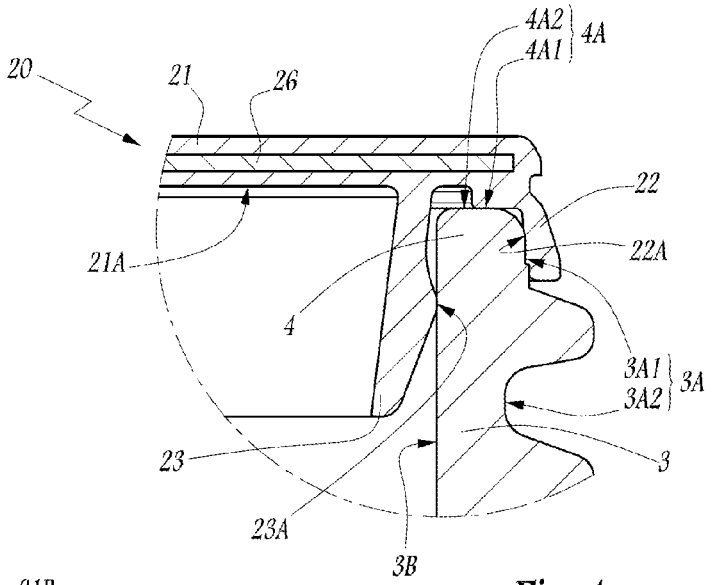
FIG. 4 is a view to a larger scale of the ringed area IV in FIG. 3.

It will be noted that, on subsequently opening the device 1, the fastening together of the insert 20 and the outer cap 10 is, so to speak, stronger than the mechanical connection between the insert 20 and the neck 2, in the sense that the force retaining the insert 20 on the neck 2, which was exploited during the operations of cleaning the neck 2, described with reference to FIGS. 3 and 4, is overcome by the fastening together of the insert and the outer cap obtained on fitting the outer cap. The ribs 17 advantageously increase the resistance to deformation of the upper end part of the skirt 12 to hold the insert 20 outer captive on opening the device 1.

In a variant of the insert 20, not shown, the exterior periphery of its body 21 may be crenelated, i.e., at its exterior periphery, the body 21 may be provided with a plurality of tongues projecting radially inward that are sized and angularly positioned so that each engages radially in one of the openings 16 of the skirt 12. Clearly this solution, more complicated in terms of the production of the insert 20, allows radial enlargement of the contact interface between the surfaces 15A of the tabs 15 and the lower face 21A of the insert 20, since the aforementioned projecting tongues can be designed to extend deeper in the openings 16, in the direction of the exterior face of the skirt 12, than can the circular transverse profile exterior periphery of the body 21 of the insert 20 considered in FIGS. 1 to 6.

By way of an optional advantageous feature, present in the embodiment of FIGS. 1 to 6, the insert 20 is designed to limit the passage of oxygen through it. To be more precise, in the embodiment considered in FIGS. 1 to 6, the body 21 of the insert 20 is provided with an oxygen-sensitive layer 26 within the thickness of this body. In practice, and in a manner that is known in itself, the material constituting the layer 26 forms an oxygen barrier or traps oxygen by fixing it. To arrive at this embodiment a plurality of manufacturing techniques may be envisaged: a first solution consists in moulding the body 21 around the layer 26 moulded independently beforehand. Another solution consists in carrying out conjointly the moulding of the body 21 and the moulding of the layer 26, typically by dual-injection of plastic materials. In a variant that is not shown, rather than being provided within the thickness of the body 21, the layer 26 may be fixed against the lower face 21A of the body 21, inside the lip 23: this fixing may be obtained by dual-injection of plastic materials or by adhesive bonding. Similarly, another alternative that is not shown consists in substituting for the layer 26 the addition of oxygen-sensitive agents incorporated directly into the plastic material of the body 21, before moulding the body.

Figure 7:
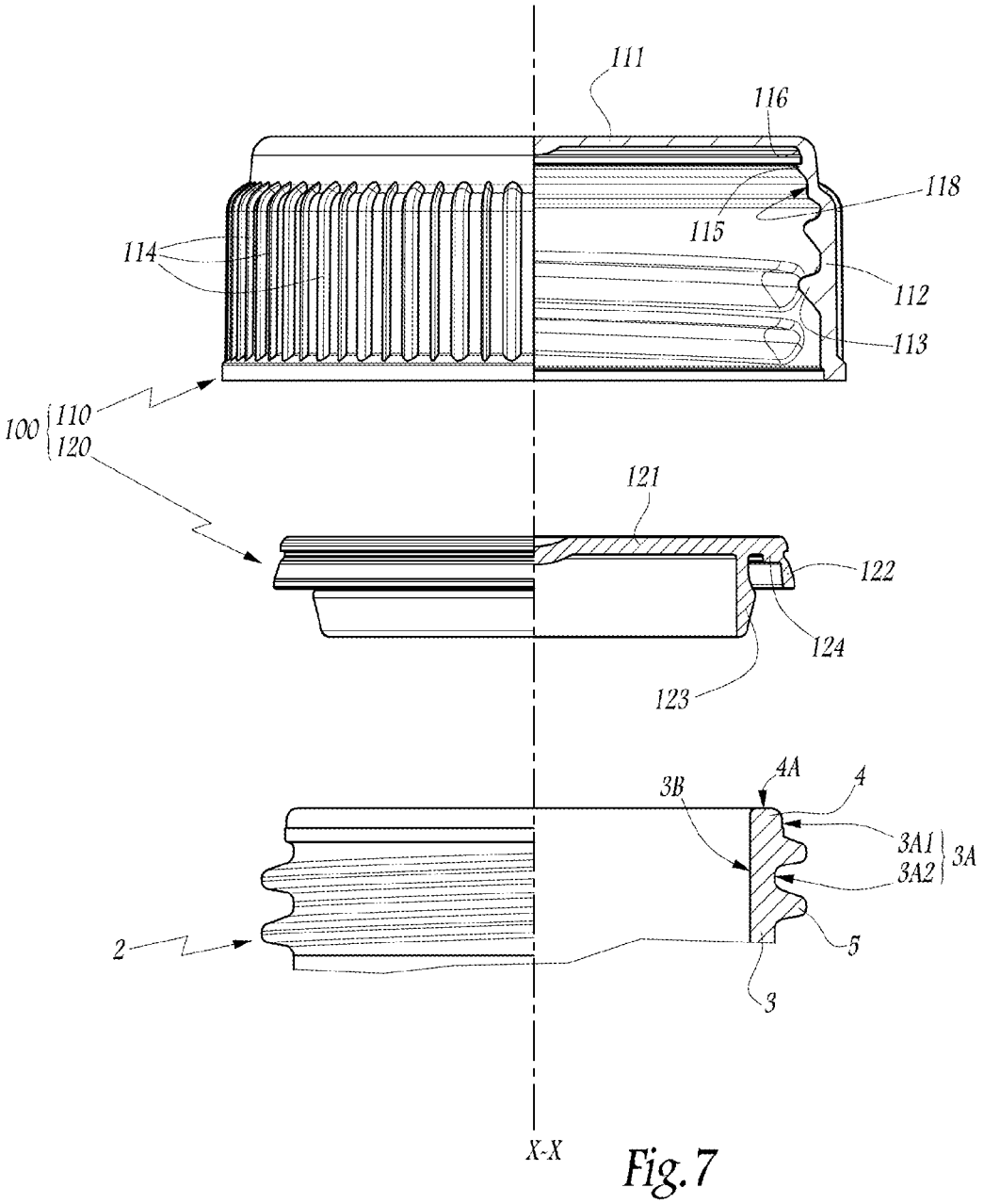
FIG. 7 is a view analogous to FIG. 1, showing a capping device of a second embodiment of the invention.
Figure 8:
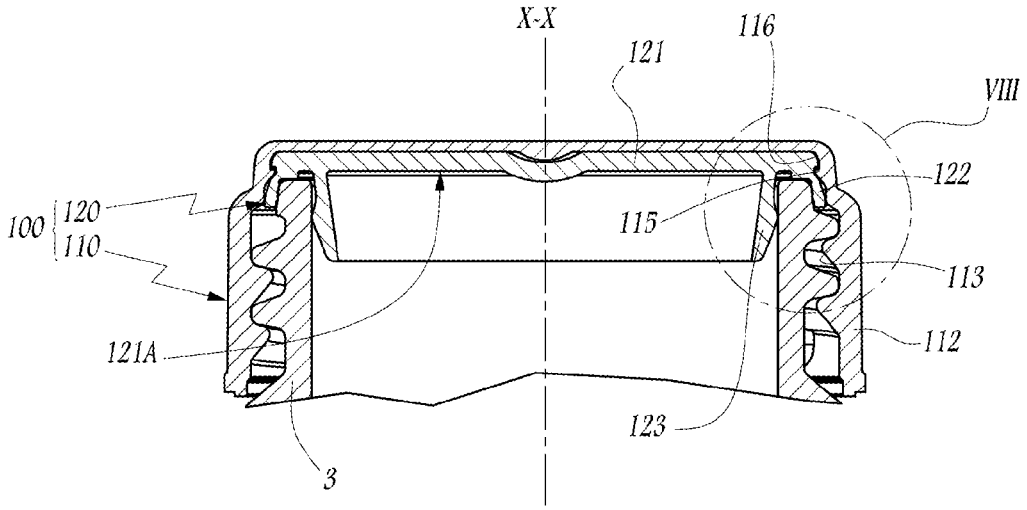
FIG. 8 is a view analogous to FIG. 5 for the FIG. 7 embodiment.
Figure 9:
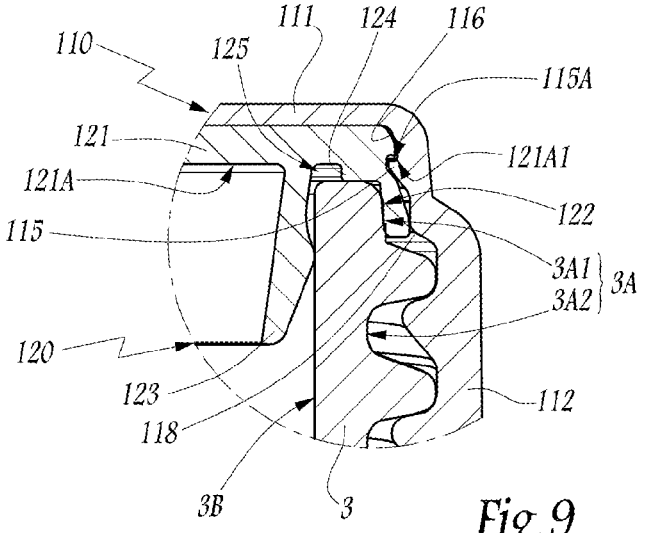
FIG. 9 is a view to a larger scale of the ringed area IX in FIG. 8.

In FIGS. 7 to 9 there is represented a capping device 100 constituting an alternative embodiment of the device 1. This device 100 includes a outer cap 110 and an insert 120 functionally similar to the outer cap 10 and the insert 20 of the device 1. As explained in more detail later, the device 100 differs from the device 1 essentially in how the outer cap 110 and the insert 120 are fastened together on fitting the outer cap 110. The insert 120 also differs from the insert 20 through the absence of an oxygen-sensitive layer, such as the layer 26. Accordingly, the outer cap 110 comprises an end wall 111 and a skirt 112 with a thread 113, ribs 114 and a lower surface 118 which are functionally similar to the end wall 11, skirt 12, thread 13, ribs 14 and surface 18 of the outer cap 10. Similarly, the insert 120 comprises a body 121 with an exterior sealing lip 122, an interior sealing lip 123 and a heel 124 associated with a free space 125 which are respectively similar to the body 21, lips 22 and 23, heel 24 and space 25 of the insert 20.

Differing in this respect from the outer cap 10, the upper end part of the skirt 112 of the outer cap 110 is solid all around its periphery, has a substantially smooth exterior face and is provided internally with a groove 116 that runs around all of the interior periphery of the skirt, in the connecting area between this skirt and the end wall 111. This groove 116 is sized to receive the exterior periphery of the body 121 when fitting the outer cap 110 over the insert 120 previously fitted to the neck 2, as represented in FIGS. 8 and 9. The groove 116 is substantially complementary to the exterior periphery of the body 21 and is flanked on its lower axial side by a shoulder 115 projecting radially toward the inside of the skirt 112. Thus, at the axial level of its lower side, the groove 116 opens onto the upper surface 115A of the shoulder 115, on which the exterior peripheral surface 121A1 of the lower face 121A of the body 121 bears down, as can be seen clearly in FIG. 9. Accordingly, the cooperation between the exterior periphery of the body 121 of the insert 120 and the groove 115 of the outer cap 110 is similar to that between the exterior periphery of the body 21 of the insert 20 and the tabs 15 of the outer cap 10. However, it will be noted that, in practice, all other things being equal, the radial extent of the upper surfaces 15A of the tabs 15 may advantageously be made greater than the radial dimension of the shouldered surface 115A flanking the groove 116, for reasons linked to the manufacture of the outer caps 10 and 110. When moulding the outer cap 110, it remains difficult to achieve a large radial extent of the shouldered surface 115A, given mould extraction constraints. In this context, recourse to an eclipsable moulding core is advantageously preferred.

In a variant of the outer cap 110 that is not shown its groove 116 may be regularly interrupted Around the periphery of the skirt 112, which amounts to saying that the groove 116 from FIGS. 7 to 9 is replaced by a plurality of notches, distributed along the interior periphery of the skirt 112, the shoulder 115 then remaining in its uninterrupted form along the interior periphery of the skirt 112 or being interrupted like the groove.

Various adaptations and variants of the devices 1 and 100 described until now may be envisaged. For example:

- rather than fastening together the outer cap 10 or 110 and the insert 20 or 120 by cooperation between the exterior periphery of the insert and the skirt of the outer cap, this fastening may be obtained by cooperation between dedicated features of the end wall of the outer cap and complementary dedicated features of the upper face of the body of the insert; for example, complementary clipping tongues may be provided projecting from the central region of the end wall of the outer cap and the central region of the upper face of the body of the insert; compared to the embodiments shown in the figures, this solution may lead to a capping device that is slightly more bulky in the direction of the axis X-X;
- in addition to, or instead of, the mechanical fastening together of the outer cap and the insert described until now, other modes of fastening may be envisaged, notably by adhesive bonding and/or by welding; one particularly advantageous option is for the insert, placed on the container neck before the latter is cleaned, and the outer cap, which is put onto the container neck after it is cleaned and with the insert left in place thereon, to be welded to each other, in particular directly to each other, by laser welding, such laser welding being carried out by ad hoc means known in themselves;

in addition to the diverse fastening solutions between the outer cap and the insert referred to above, additional features may be provided for rotationally connecting the outer cap and the insert; returning to the embodiment of FIGS. 1 to 6, for example, the upper face 21B of the body 21 of the insert 20 and the lower face of the end wall 11 may be at least partly striated in complementary manner in order to prevent rotation of the insert 20 relative to the outer cap 10, as well as being retained in the axially downward direction by the tabs 15; the outer captive retention of the insert 20 inside the outer cap 10 during manipulation thereof to open and, where applicable, reclose the device 1 is strengthened by this;

embodiments other than the threads 13 or 113 may be envisaged for the removable fixing of the skirt 12 or 112 to the neck 2; for example, this skirt may be provided internally with one or more clips designed to be wedged onto an exterior raised pattern projecting from the neck; and/or means for making evident the first opening of the device 1 or 100 may be added, typically in the form of a tamper-evident strip or a tongue which, on first opening of the device, is separated from the skirt 12 or 112.

The invention claimed is:

1. Device for capping a container neck comprising:

an external outer cap adapted to be removably fixed to an exterior face of a container neck; and an internal insert adapted to plug the opening of the neck, wherein the insert is adapted to be fitted to the neck independently of the outer cap and before fitting the outer cap to the neck, and wherein the outer cap is adapted, when it is fitted to the neck, to be permanently fastened to the insert wherein the insert includes:

means for retaining the insert on the neck and adapted to connect the insert mechanically to the neck before the outer cap is fitted to the neck, and for sealing at least an exterior peripheral surface of a free end of the neck, before the outer cap is fitted to the neck, against a cleaning liquid applied externally to the neck;

a body adapted to cover transversely the free end of the neck and positioned on a side of the insert that is configured to face the neck, wherein the body has a face for capping the opening of the neck, wherein said retaining means includes:

an exterior sealing lip having an annular shape projecting axially from the capping face and an internal face, which is adapted to bear against and seal the exterior peripheral surface of the free end of the neck; and an interior sealing lip having an annular shape that projects axially from said capping face and an external face having a raised pattern adapted to bear against and seal an internal face of the neck; and a projecting heel arranged in a connecting area between the capping face of the body and the internal face of the exterior sealing lip, wherein the projecting heel is adapted to bear against and seal an exterior peripheral part of an edge of the free end of the neck while providing in the connecting area between the capping face and the external face of the interior sealing lip a free space between the capping face and an interior peripheral part of the edge.

2. Device according to claim 1, wherein the outer cap includes:

a substantially tubular skirt defining a central axis and having means for removably fixing the skirt to the exterior face of the neck, and an end wall extending across one axial end of the skirt and against which at least part of the capping face of the body of the insert bears during fitting of the outer cap to the neck, wherein the skirt has an internal retaining raised pattern adapted, after the outer cap is fitted to the neck, to retain the insert axially in a direction away from the end wall by engaging with an exterior peripheral part of the capping face of the body of the insert.

3. Device according to claim 2, wherein the retaining raised pattern includes tabs projecting from the interior face of the skirt, and wherein the skirt includes openings situated in the direction of the axis of the skirt between the tabs and the end wall, and wherein the openings open in a direction transverse to the axis.

4. Device according to claim 2, wherein an interior of the skirt defines a groove for receiving the insert that runs in a continuous or interrupted manner around the periphery of the skirt, the axial end of the groove at the opposite end of the end wall includes a shoulder projecting toward the interior of the skirt to form said retaining raised pattern.

5. Device according to claim 2, wherein an internal of the skirt includes, axially between the retaining raised pattern and the removable fixing means, a surface adapted to bear against the external face of the exterior sealing lip.

6. Device according to claim 2 wherein the end wall of the outer cap and the face of the body of the insert on the opposite side of the capping face of the body include raised patterns adapted, after the outer cap is fitted to the neck, to connect the outer cap and the insert either rotatably about the axis of the skirt or in translation along the axis.

7. Device according to claim 2, wherein the end wall of the outer cap and the body of the insert are connected by adhesion or welding.

8. Device according to claim 7, wherein the end wall of the outer cap and the body of the insert are connected by laser welding.

9. Device according to claim 1, wherein the insert and the outer cap are fastened together by laser welding.

10. Device according to claim 9, wherein the insert and the outer cap are fastened together using only laser welding.

11. Device according to claim 1, wherein the insert includes an oxygen fixing layer either within the thickness of the body of the insert or fixed to the capping face of the body.

* * * * *

UNITED STATES PATENT AND TRADEMARK OFFICE

CERTIFICATE OF CORRECTION

PATENT NO. : 9,278,784 B2
APPLICATION NO. : 13/824615
DATED : March 8, 2016
INVENTOR(S) : Christopher Wood et al.

It is certified that error appears in the above-identified patent and that said Letters Patent is hereby corrected as shown below:

Claims

Claim 5, Col. 10, Line 34, "wherein an internal of the" should read as --wherein an interior of the--.

Signed and Sealed this
Tenth Day of May, 2016

Michelle K. Lee

Michelle K. Lee
*Director of the United States Patent and Trademark Office*